US006929487B1

(12) United States Patent
Raghavendra et al.

(10) Patent No.: US 6,929,487 B1
(45) Date of Patent: Aug. 16, 2005

(54) TERMINAL BLOCK ARRANGEMENT FOR A PRINTED CIRCUIT BOARD IN A SMART CONNECTOR

(75) Inventors: Vijendra Raghavendra, Ann Arbor, MI (US); James L. Jones, III, Belleville, MI (US); Truong Q. Nguyen, Canton, MI (US); Larry J. Kim, Ann Arbor, MI (US); David Kwang, Southfield, MI (US)

(73) Assignee: Yazaki North America, Inc., Canton, MI (US)

( * ) Notice: Subject to any disclaimer, the term of this patent is extended or adjusted under 35 U.S.C. 154(b) by 12 days.

(21) Appl. No.: 10/932,027

(22) Filed: Sep. 2, 2004

(51) Int. Cl.[7] ..... H01R 12/00
(52) U.S. Cl. ..... 439/76.1; 439/654
(58) Field of Search ..... 439/76.1, 654, 439/655, 638, 79, 945, 946

(56) References Cited

U.S. PATENT DOCUMENTS 5,299,942 A * 4/1994 Burke et al. ..... 439/79
5,454,737 A 10/1995 Saba
5,668,698 A 9/1997 Jozwiak et al.
6,004,145 A * 12/1999 Gasparovic et al. ..... 439/76.1
6,053,775 A * 4/2000 Ungermann et al. ..... 439/630
6,099,324 A 8/2000 Janssen et al.
6,132,223 A * 10/2000 Seeley et al. ..... 439/76.1
6,134,114 A * 10/2000 Ungermann et al. ..... 439/945
6,485,322 B1 * 11/2002 Branch et al. ..... 439/76.1

* cited by examiner

*Primary Examiner*—Tho D. Ta
(74) *Attorney, Agent, or Firm*—Daniel R. Edelbrock

(57) ABSTRACT

In a smart or intelligent electrical connector assembly, a printed circuit board (PCB) mounted in a first connector has circuit traces that extend from various locations on the PCB to a single, particular area between edges of the PCB. Components such as switches and microcontrollers for controlling the connector assembly circuits are electrically connected to the traces at the various locations. A terminal block is mounted at the single, particular area. The terminal block has terminals with ends electrically connected with the traces. The other ends of the terminals extend outward from surfaces of the block towards the edges of the PCB. Wire harness terminals within the first connector and within a second, mating connector of the assembly electrically connect with the terminal block terminals. By having the PCB terminals extend from a location inward from and above the PCB edges, rather than being located directly on the edges themselves, the PCB can be made smaller and the connectors can have a more telescopic fit, resulting in a compact connector assembly.

16 Claims, 5 Drawing Sheets

TERMINAL BLOCK ARRANGEMENT FOR A PRINTED CIRCUIT BOARD IN A SMART CONNECTOR

BACKGROUND OF THE INVENTION

1. Field of the Invention

This invention relates in general to smart or intelligent electrical connectors and more specifically to a compact connector assembly including an inner printed circuit board on which is mounted a terminal block positioned for close electrical connection with terminals of mating connectors.

2. Discussion of Related Art

It is known in the art to integrate control electronics within an electrical connector to provide load control at strategic locations at or closer to the load rather than at a more centralized location in a control circuit module. This can reduce the number and length of wires, and the number of connectors. Examples of these locations would include within vehicle doors at lock actuators, side-mirror remote manipulators, and window-operating motors. Electronics are embedded inside the in-line connection system for power switching and controls. Once the connection is made at the final assembly, the wiring becomes "smart" or "intelligent." The smart connectors eliminate the need for a separate control circuit module and the necessary extra wire, and directly replace connectors not having control electronics.

The typical mechanical structure of these smart connectors has electrical terminals mating at edges of an internal printed circuit board (PCB). One approach to adding mating connectors to a PCB has been to first place all the electronic components on a surface of the PCB in electrical contact with copper circuit traces and then route the circuit traces to the edge of the board. Co-pending, commonly owned U.S. patent application Ser. No. 10/624,073, filed Jul. 21, 2003, illustrates this concept. The PCB has flush edge contacts. Spring portions on terminals in each of the mating connectors engage the edge contacts. Another approach is disclosed in U.S. Pat. No. 5,668,698. The circuit traces extend onto male blades projecting outward from the very edge of the circuit board. The engagement with female terminals of a connecting wire harness has to be made beyond the extreme edge of the board, increasing the size of the smart connector assembly.

SUMMARY OF THE INVENTION

Accordingly, it is an object of this invention to provide a compact, smart electrical connector assembly.

Another object of the invention is to eliminate the need to have terminal connections made on the edges of the printed circuit board (PCB) in a smart connector, reducing the necessary size of the PCB.

A further object of the invention is to equip the PCB within a smart connector with a terminal block that can be configured to have sets of terminals arranged and positioned depending on the requirements of the mating connector.

In carrying out this invention in the illustrative embodiment thereof, circuit traces on a PCB are directed inward relative to edges of the PCB from various locations to a particular area on the PCB surface. Circuit control components, such as switches and microcontrollers, are mounted at these various locations on the PCB surface in electrical connection with the circuit traces. The particular area is generally centrally located on the PCB, or may be located at one edge of the PCB. At this particular area, a contact or terminal block is secured on the PCB surface. The terminal block is molded around electrically conductive contacts or terminals having first ends extending through an underside of the block for electrical connection, such as by soldering, with the circuit traces in the particular area. Second ends of the contacts or terminals extend outward from other sides of the block toward or over the edges of the PCB. These second ends may be arranged in tiers.

The PCB is secured in an interior chamber of a first connector. The first connector has internal electrical terminals that mate with the terminal block contacts on one side of the block. A second connector is designed to fit within the chamber and lock together with the first connector. The second connector has internal terminals that electrically engage the contacts extending from an opposite side of the block. In this way, the two wire harness connectors are electrically mated by an in-line connection within the first connector. Because the terminals are mated over the PCB surface rather than by PCB edge connections, the length of the PCB can be made shorter and the connectors can be more closely fit together, minimizing overall connector size and reducing material cost. In other words, this design enables the size of the PCB to be dramatically reduced and therefore provides a more compact smart connector assembly.

BRIEF DESCRIPTION OF THE DRAWINGS

This invention, together with other objects, features, aspects and advantages thereof, will be more clearly understood from the following description, considered in conjunction with the accompanying drawings.

DETAILED DESCRIPTION OF THE ILLUSTRATED EMBODIMENT

Figure 1:
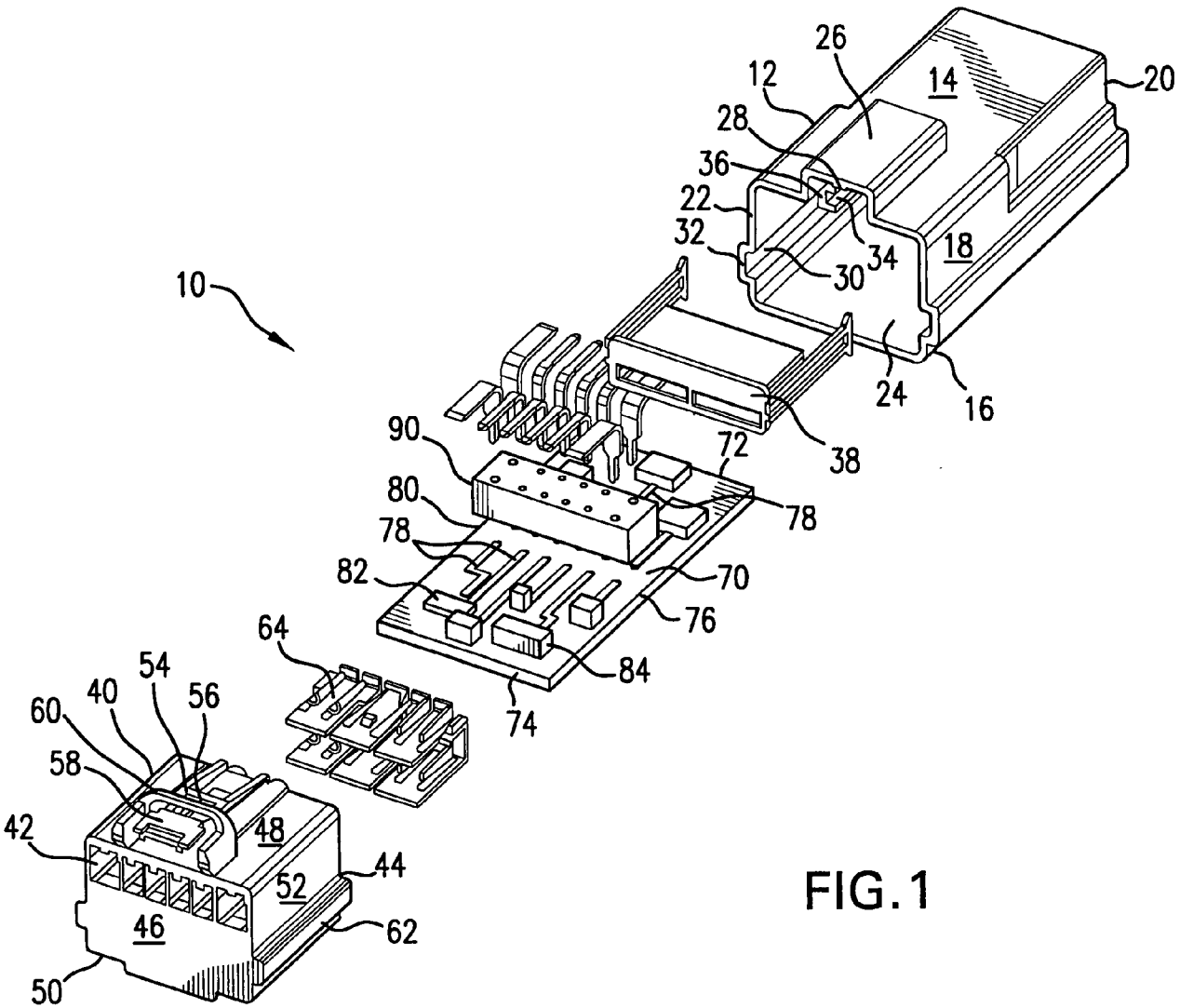
FIG. 1 is an exploded perspective view illustrating components of a smart electrical connector assembly according to the present invention.

Referring now to FIG. 1, a connector assembly 10 according to the present invention is illustrated. A first connector 12, injection molded, for example, from an electrically non-conductive suitable plastic such as polyethylene, has a housing with a top surface 14, an underside 16, and side walls 18. A first end 20 includes terminal accommodating chambers (not shown) for receiving electrical terminals crimped onto stripped ends of electrical wires bundled in a wire harness. A second, opposite end 22 has an open, relatively large interior compartment 24. An outer lock housing 26 is located on the top surface 14 of the connector 12 adjacent the second end 22. The lock housing includes a lock projection 28 extending towards the interior compartment 24. The side walls 18 each have a longitudinal channel 30 communicating with the interior compartment 24 and protruding outward from the side walls. The channels 30 have openings 32 at the second end 22 of the connector 12. At a distance spaced inward from the second end 22 of the connector 12, the channels 30 each step down in size to smaller, u-shaped channels or slots 34. A stop 36 is formed in each channel 30 at the location of this size change.

A terminal position assurance (TPA) member 38 for the connector 12 is illustrated in FIG. 1. The TPA member 38 is used to help ensure the position of the electrical terminals in the terminal accommodating chambers of the connector 12. The TPA member 38 and the TPA member's engagement with the connector 12 and terminals are conventional features known in the art and will not be particularly described.

A second, mating connector 40, also molded from an electrically non-conductive plastic, has a housing with terminal accommodating chambers 42 for receiving electrical terminals crimped onto the stripped ends of wires bundled in a harness. The second connector 40 has a first end 44, a second end 46, a top surface 48, an underside 50 and side walls 52. The top surface 48 has a deflectable, cantilevered lock arm 54 with an aperture 56 and a free end 58 adjacent the second end 46 of the connector 40. An arched lock guard 60 partially surrounds the free end 58 adjacent the second end of the second connector. The side walls 52 of the second connector 40 each include an outwardly protruding rib 62 extending along the length of the side wall, located on the side wall just upward from the underside 50 of the connector.

The second connector 40, like the first connector 12, has an associated TPA member 64. The TPA member is inserted from the first end 44 to help ensure the position of the terminals in the chambers 42 in conventional manner. The second connector 40 is sized to be telescopically received in the interior compartment 24 of the first connector. The ribs 62 of the connector 40 are positioned to be received in the channels 30 of the connector 12.

Figure 2:
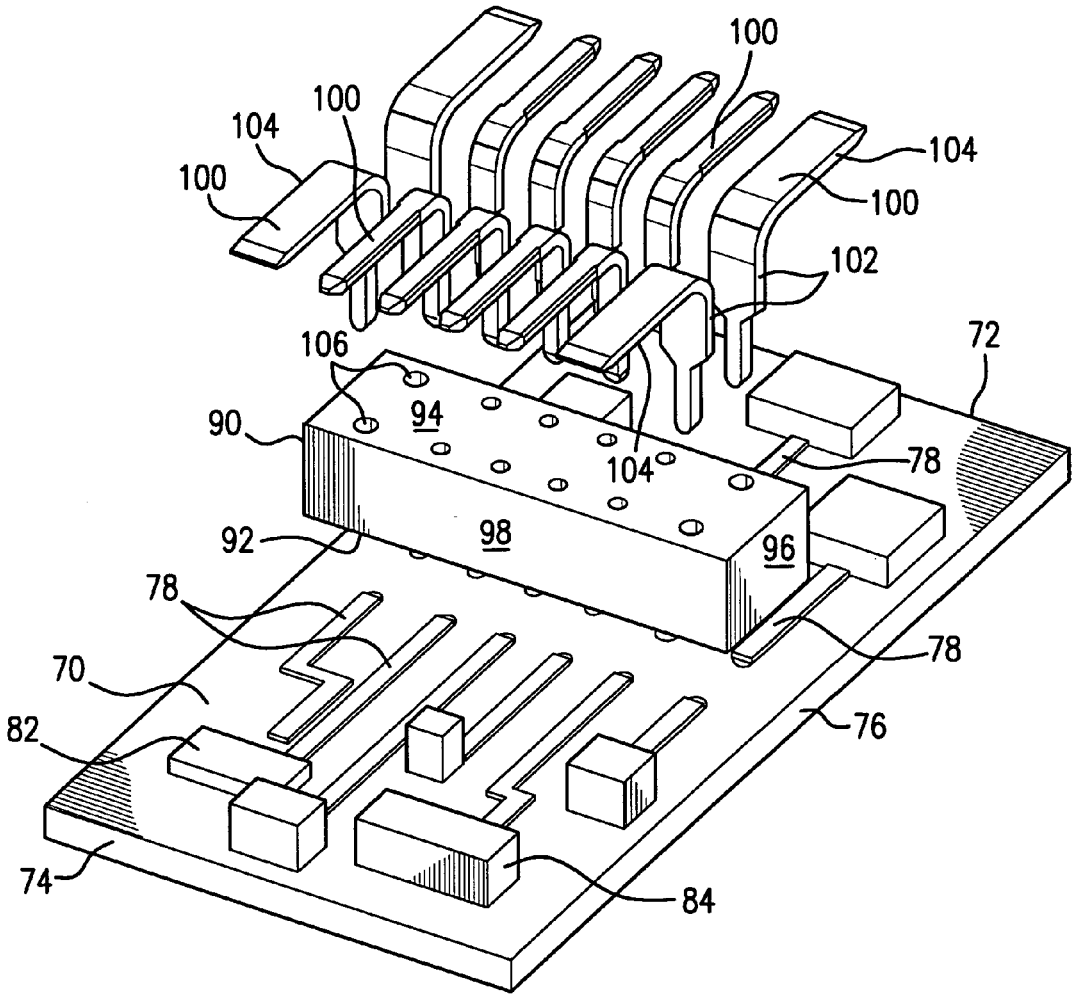
FIG. 2 is an enlarged perspective view of a terminal block and printed circuit board for use in the assembly.

The connector assembly 10 includes a printed circuit board (PCB) 70, as best illustrated in FIGS. 1 and 2. The PCB 70 has a first edge 72, an opposite second edge 74, and outer sides 76. The PCB is sized such that the sides 76 slide into the slots 34 of the first connector 12. The PCB includes circuit traces 78. The circuit traces extend from various locations on the PCB toward a single, particular area, in this case a central part 80 of the PCB approximately mid-way between the edges of the PCB. Circuit components, such as timer circuit 82 and microprocessor 84, only broadly represented, are mounted at the various locations in electrical connection with the circuit traces. The timer circuit, for example, could include a switch to control the on/off of the load device based on a time constraint. The microprocessor, for example, would control the load device based on an incoming signal.

Other circuit components, such as capacitors, resistors and application specific integrated circuits could be mounted on the PCB 70. These various circuit components enable local control of the current through the circuits of the connector assembly 10, providing a smart or intelligent connector assembly. For example, bundled wires terminated by the electrical terminals received in connector 40 would bring power, ground and control signals to the PCB. Wires terminated by the electrical terminals received in the first connector 12 would output power, ground and command signals from the PCB to the load, such as a window-operating motor.

A contact block or terminal block 90 is configured for attachment to the central part 80 of the PCB 70. The terminal block 90 is attached by, for examples, screws, rivets or other types of fasteners extending through the block and PCB. Alternatively, the terminal block could be attached to the PCB by adhesive or in some other conventional manner. The terminal block is molded or otherwise formed from an electrically non-conductive material. As best illustrated in FIG. 2, the block has an underside 92 for engagement against the PCB, a top surface 94, outer ends 96 corresponding to the outer sides 76 of the PCB, and opposite walls or sides 98 facing toward the edges 72 and 74 of the PCB.

In the particular embodiment illustrated in FIG. 2, electrical contacts or terminals 100 extend from the top surface 94 of the terminal block and are bent toward the edges 72 and 74 of the PCB. The terminals may be, for example, formed from an electrically conductive metal and insert molded into the terminal block 90. The terminals each have first sections 102 and second sections 104 extending at right angles to the first sections 102 outward over the sides 98 of the block. The first sections 102 are routed through passages 106 in the block and out the underside 92 of the block, where they are engaged, and securely electrically connected, for example by a soldering process, with the circuit traces 78 of the PCB. As an alternative to insert molding, the terminals 100 could be press-fit in the passages 106. In addition, the solder electrically connecting the terminals to the circuit traces 78 in some cases could be sufficient to secure the terminal block 90 to the PCB, eliminating the need for other fasteners between the block and PCB.

The second sections 104 of the terminals 100 are depicted as being male terminals or pins and would mate with spring portions of female terminals in the connectors 12 and 40. However, the contacts or terminals in the terminal block may be female terminals, or male terminals on one side and female terminals on the other, depending on the type of terminals in each connector. The terminals 100 could also be configured to protrude from the sides 98 of the block rather than or in addition to the top surface 94, depending on height or other mating requirements. It should also be noted that the terminal block 90 might also be placed on a bottom or opposite surface of the PCB 70 relative to the circuit components, depending on space requirements. The contacts or terminals 100 electrically connect the circuit components on the PCB with the terminals in the terminal accommodating chambers of the connectors, such that the circuit components control the circuits joined by the connector assembly.

Figure 3:
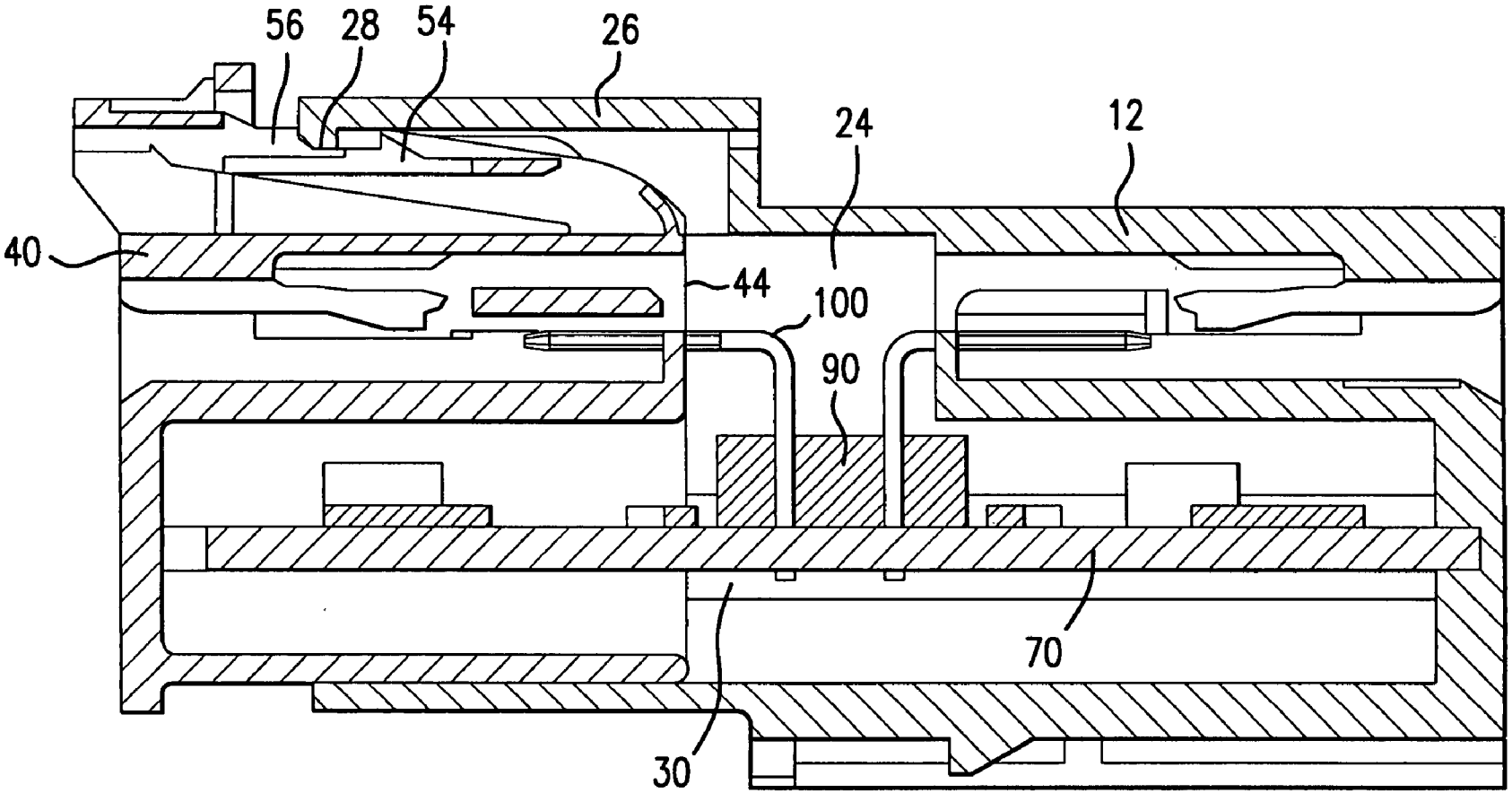
FIG. 3 is a cross-sectional side view of the components assembled together.
Figure 4:
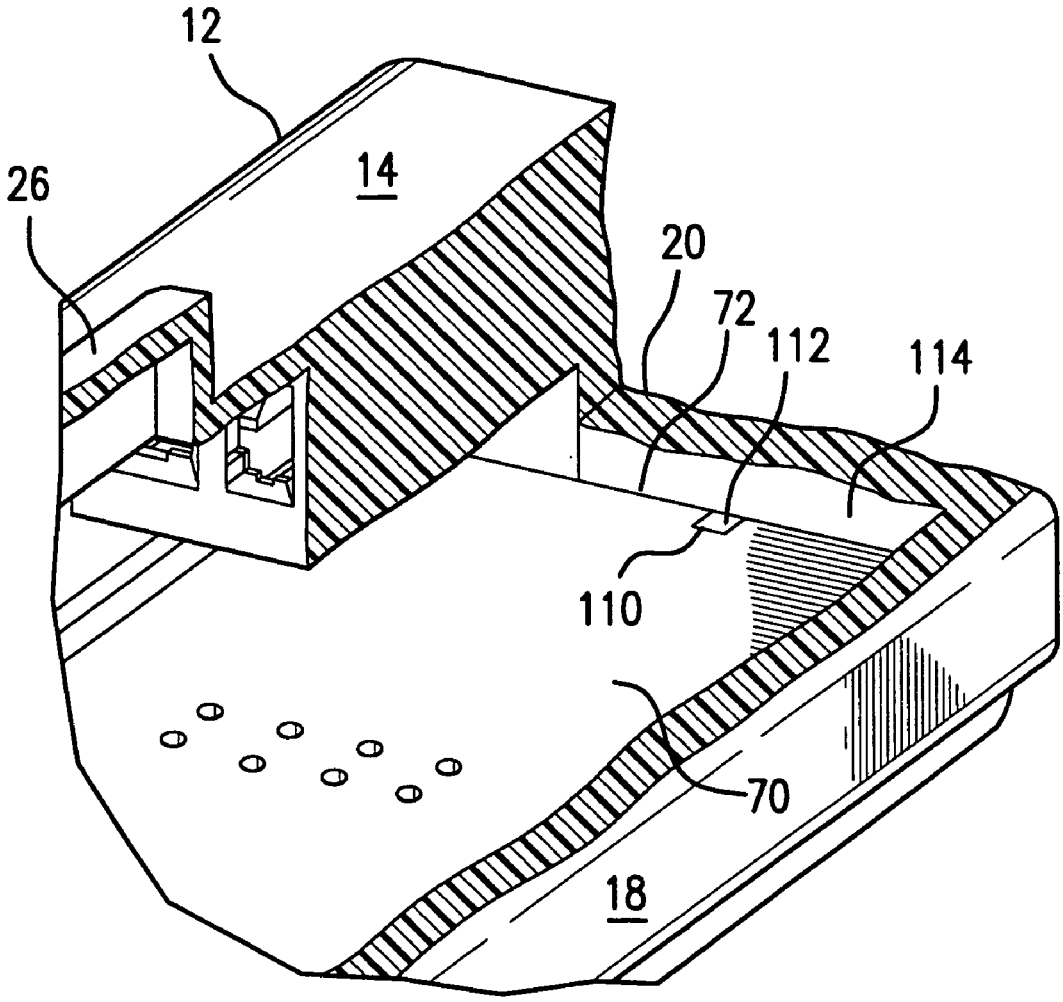
FIG. 4 is a partial perspective view illustrating an orientation feature for ensuring correct insertion of the printed circuit board in a connector of the assembly.

The engagement between the terminal block 90 and PCB 70, and between the first connector 12 and the second connector 40, is generally illustrated in the cross-sectional side view of FIG. 3. In the interest of clarity, the optional, conventional TPA members 38 and 64 are excluded from the Figure. The PCB is first slid into the slots 34 in the internal compartment 24 of the first connector 12. A suitable orientation feature, for example as simply illustrated in FIG. 4, would be used to ensure the PCB is inserted right-side-up and correct-edge first. This orientation feature may include a notch 110 in the first edge 72 of the PCB and a protrusion 112 extending inward from a surface 114 located adjacent the first end 20 of the connector 12. The protrusion would fit into the notch and only enable complete insertion of the PCB into the first connector when the PCB is properly oriented.

Referring again to FIG. 3, the first end 44 of the second connector 40 is inserted into the interior compartment 24 of the first connector 12. The ribs 62 on the side walls 52 of the second connector slide into the channels 30 in the side walls 18 of the first connector until they abut against the stops 36. At this point of engagement, the lock projection 28 in the outer lock housing 26 of the first connector is received in the aperture 56 of the deflectable lock arm 54 on the top surface 48 of the second connector. The lock arm and lock housing may be of types other than illustrated. They enable the connectors to be both securely engaged in the terminal mating condition and releasable from this condition.

Figure 5:
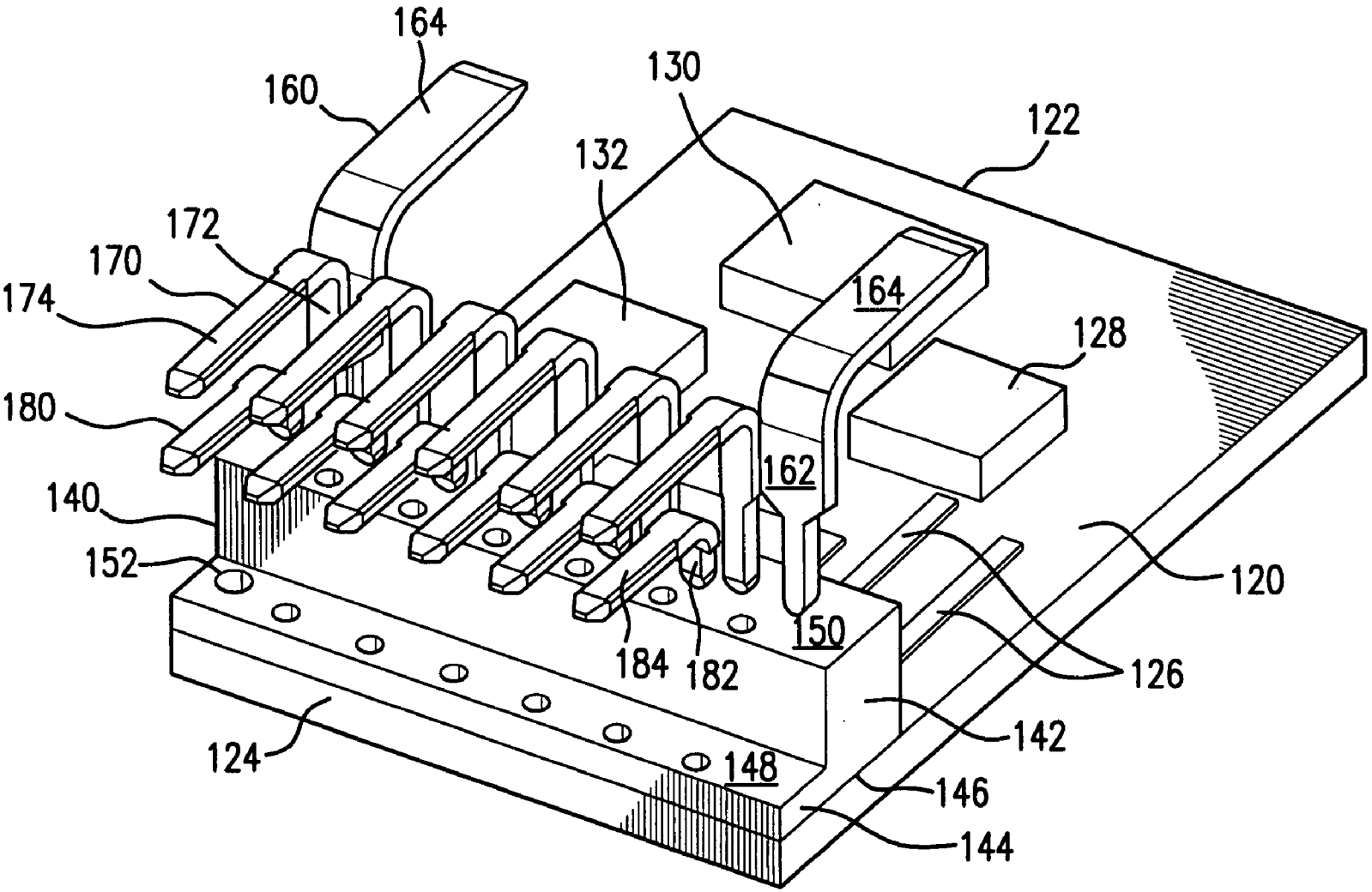
FIG. 5 is an enlarged perspective view of a modified terminal block and printed circuit board.

Different connection systems require different terminal arrangements. For example, a smart connector assembly for power-lock operation in a vehicle door may require more electrical terminals arranged in different levels. However, by using the concept of this invention, the connector assembly can still be made compact. The modified embodiment illustrated in FIG. 5 demonstrates how this can be accomplished. A PCB 120 has a first edge 122 and a second edge 124. Circuit traces 126 extend from various locations on the PCB toward the second edge 124. Circuit components 128, 130 and 132 are mounted at the various locations in electrical connection with the circuit traces.

A contact block or terminal block 140 for use with the PCB 120 is manufactured from an electrically non-conductive material and has a main portion 142 and a supplementary portion 144. The supplementary portion 144 extends at a right angle from the main portion 142. The main and supplementary portions share a common bottom surface 146 for engaging the PCB adjacent the second edge 124, with the supplementary portion being positioned closest to the edge 124. The supplementary portion has a top surface 148 significantly lower in height relative to the PCB than a top surface 150 of the main portion. The supplementary portion includes an aperture 152 through which a fastener can extend as one type of method for securing the block 140 to the PCB 120.

There are three sets of electrically conductive electrical contacts or terminals that, though they are illustrated separate from the block 140, may be insert-molded with the block. The terminals of a first set 160 each have a first section 162 extending through the main portion 142 of the terminal block and out the bottom surface 146 for electrical engagement, and secure electrical connection, such as by soldering, with the circuit traces 126. A second section 164 bent at a right angle to the first section extends from the top surface 150 of the main portion toward the first edge 122 of the PCB 120. The terminals of a second set 170 each have a first section 172 extending through the main portion 142 of the terminal block and out the bottom surface 146 for electrical connection with the circuit traces 126. A second section 174 bent at a right angle to the first section extends from the top surface 150 of the main portion toward the second edge 124 of the PCB 120.

A third set 180 of terminals each have a first section 182 extending through the supplementary portion 144 of the terminal block and out the bottom surface 146 for electrical connection with the circuit traces 126. A second section 184 bent at a right angle to the first section extends from the top surface 148 of the supplementary portion out over the second edge 124 of the PCB 120. The second and third sets 170 and 180 of terminals provide an arrangement of terminals in tiers extending over the second edge 124 of the PCB for connection with similarly arranged terminals in a mating connector. Further modifications to the terminal block design using this concept can provide many interchangeable and compatible terminal connection arrangements.

Though the sets of terminals of the terminal block 140 are illustrated to be of particular relative sizes and lengths, they can be selected according to the size requirements of the terminals in the mating connectors. While the terminals of the terminal block 140 are depicted as protruding out from the top surfaces of the block, they can extend outward from other surfaces of the block, such as from the surfaces perpendicular to the PCB and facing toward the edges of the PCB. In addition, they can be of different types, male or female, depending on the needs of the particular connections. The terminal block 140 is only meant to be an example of possible tiered designs. It is the arrangement of the terminals and their positioning based on the location of the terminal block on the PCB that enable the smart connector assemblies in which the block and PCB are used to be compact and convenient. The resulting electrical connections are more reliable and serviceable. Furthermore, while the present invention is described as being useful in automotive applications, it would also add benefits to electrical connections in other environments, such as within other types of transportation vehicles, and within computers and household appliances.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. An electrical connector comprising:

a connector housing, the housing having first and second open ends;

a circuit board secured within the connector, the circuit board having a first edge adjacent to the first end of the connector housing, a second edge adjacent to a second end of the connector housing, and a particular area located between the first and second edges, the circuit board further including circuit traces extending from various locations on the circuit board to the particular area of the circuit board;

circuit components positioned at the various locations on the circuit board in electrical connection with the circuit traces; and a terminal block mounted on the particular area of the circuit board, the terminal block having first and second sides, the terminal block having terminals in electrical connection with the circuit traces and extending away from the first and second sides toward the first and second edges of the circuit board.

2. The electrical connector of claim 1 wherein the terminals in electrical connection with the circuit traces are soldered to the traces.

3. The electrical connector of claim 1 wherein the connector housing has two side walls and the circuit board has outer sides extending between the first and second edges, the circuit board outer sides being received in channels in the connector housing side walls.

4. The electrical connector of claim 1 wherein the particular area of the circuit board is approximately mid-way between the first and second edges.

5. The electrical connector of claim 1 wherein the particular area is immediately adjacent to the second edge of the circuit board.

6. The electrical connector of claim 1 wherein the terminals extending from at least one of the first and second sides of the terminal block are arranged in sets spaced at different heights above the circuit board.

7. The electrical connector of claim 6 wherein the terminals each have a first section extending through the terminal block for electrical connection with the circuit traces, and second sections extending at right angles from the first sections.

8. The electrical connector of claim 1 wherein the terminal block has a main portion and a supplementary portion, the main portion having a greater height above the circuit board than the supplementary portion, and the terminals extend from both the main and supplementary portions.

9. The electrical connector of claim 8 wherein at least one set of terminals extend from a top surface of the main portion and at least one set of terminals extend from a top surface of the supplementary portion.

10. A connector assembly comprising:

a first connector having an interior compartment, the first connector having internal electrical terminals;

a circuit board for being received in the interior compartment of the first connector;

a block device mounted on the circuit board, the block device having a first side and a second, opposite side, and electrical contacts extending from each side, the contacts being in electrical engagement with the circuit board, and the contacts on the first side being for electrical connection with the terminals of the first connector; and a second connector having a mating end for insertion into the interior compartment of the first connector, the second connector having internal electrical terminals, the contacts extending from the second side of the block device being arranged for electrical connection with the terminals of the second connector.

11. The connector assembly of claim 10 wherein the block device is mounted on a central part of the circuit board.

12. The connector assembly of claim 10 further comprising a member for ensuring the position of the terminals in the first connector.

13. The connector assembly of claim 10 further comprising a member for ensuring the position of the terminals in the second connector.

14. The connector assembly of claim 10 further comprising circuit traces on the circuit board, the circuit traces providing the electrical engagement of the circuit board with the block device contacts.

15. The connector assembly of claim 14 wherein the block device contacts are soldered to the circuit traces.

16. The connector assembly of claim 14 further comprising circuit components secured at various locations on the circuit board in electrical engagement with the circuit traces.

* * * * *